US006342180B1

(12) United States Patent
Lefebvre et al.

(10) Patent No.: US 6,342,180 B1
(45) Date of Patent: Jan. 29, 2002

(54) MAGNESIUM-BASED CASTING ALLOYS HAVING IMPROVED ELEVATED TEMPERATURE PROPERTIES

(75) Inventors: Michel Lefebvre, Pierrefonds; Mihriban Ozden Pekguleryuz, Pointe-Claire; Pierre Labelle, St-Hyppolyte, all of (CA)

(73) Assignee: Noranda, Inc., Toronto (CA)

( * ) Notice: Subject to any disclaimer, the term of this patent is extended or adjusted under 35 U.S.C. 154(b) by 0 days.

(21) Appl. No.: 09/587,607

(22) Filed: Jun. 5, 2000

(51) Int. Cl.[7] ..... C22C 23/02

(52) U.S. Cl. ..... 420/407; 420/408; 420/409; 420/410; 148/420

(58) Field of Search ..... 148/420; 420/407, 420/408, 409, 410

(56) References Cited

U.S. PATENT DOCUMENTS

| | | | |
|---|---|---|---|
| 2,073,515 | A | 3/1937 | Fischer |
| 2,185,452 | A | 1/1940 | Wood |
| 2,185,453 | A | 1/1940 | Wood |
| 2,221,254 | A | 11/1940 | Hanawalt et al. |
| 2,233,953 | A | 3/1941 | McDonald |
| 2,270,192 | A | 1/1942 | McDonald |
| 2,380,838 | A | 7/1945 | Hanawalt |
| 2,620,270 | A | 12/1952 | Haney et al. |
| 3,320,055 | A | 5/1967 | Foerster |
| 3,370,945 | A | 2/1968 | Foerster et al. |
| 4,751,162 | A | 6/1988 | Newhouse |
| 4,855,198 | A | 8/1989 | Newhouse |
| 4,997,622 | A | 3/1991 | Regazzoni et al. |
| 5,073,207 | A | 12/1991 | Faure et al. |
| 5,078,962 | A | 1/1992 | Regazzoni et al. |
| 5,143,564 | A | 9/1992 | Gruzleski et al. |
| 5,147,603 | A | 9/1992 | Nussbaum et al. |
| 5,223,215 | A | 6/1993 | Charbonnier et al. |
| 5,340,416 | A | 8/1994 | Shibata et al. |
| 5,681,403 | A | 10/1997 | Makino et al. |
| 5,811,058 | A | 9/1998 | Baba et al. |
| 5,855,697 | A | 1/1999 | Luo et al. |

FOREIGN PATENT DOCUMENTS

| | | | |
|---|---|---|---|
| DE | 19937184 | * | 2/2000 |
| EP | 0 665 229 A | | 8/1995 |

(List continued on next page.)

OTHER PUBLICATIONS

Mihriban O. Pekguleryuz, Ph.D., "Magnesium Automotive Alloy Development at Noranda", by M.O. Pekguleryuz, PhD, Magnesium Industry, Edimet Diecasting Journal No. 10, Jun. 1999, at 36–38.

Mihriban O. Pekguleryuz, Ph.D., Development of Creep Resistant Magnesium Diecasting Alloys—An Overview, presented at Aalen Conference on Magnesium Technology in Aalen, Germany, on Sep. 30, 1999.

Nussbaum, G., et al., "New magnesium–aluminum based alloys with improved casting and corrosion properties", Chemical Abstracts (Nov. 1, 1993), vol. 119, Abstract No. 18. "Magnesium Alloys Their Appl.", [Pap. DGM Conf.] 1992, 351–8; Edited by Mordike, Barry L., et al., DGM Informationsges, Oberursel, Germany. Abstract and full–text article copy enclosed.

*Primary Examiner*—Sikyin Ip
(74) *Attorney, Agent, or Firm*—Holland & Bonzagni, PC; Mary R. Bonzagni, Esq.

(57) ABSTRACT

A magnesium-based casting alloy having improved elevated temperature properties and good salt-spray corrosion resistance. The inventive alloy comprises: 1 to 12% by wt. aluminum; 0.1 to 0.6% by wt. strontium; and 0.1 to 0.5% by wt. calcium, with the balance being magnesium except for impurities commonly found in magnesium alloys.

14 Claims, 1 Drawing Sheet

FOREIGN PATENT DOCUMENTS

| | | | | |
|---|---|---|---|---|
| EP | 799901 | A1 | | 10/1997 |
| GB | 2296256 | A | | 6/1996 |
| GB | 2 340 129 | A | | 2/2000 |
| GB | 2340129 | | * | 2/2000 |
| JP | 06279905 | | * | 10/1994 |
| JP | 06279906 | | * | 10/1994 |
| JP | 6316751 | | * | 11/1994 |
| JP | 07-278717 | A | | 10/1995 |
| JP | 07-331375 | A | | 12/1995 |
| JP | 8041576 | | * | 2/1996 |
| JP | 08041576 | | | 2/1996 |
| JP | 8260090 | | * | 10/1996 |
| JP | 08260090 | | | 10/1996 |
| JP | 08-269609 | A | | 10/1996 |
| JP | 09-104942 | A | | 4/1997 |
| JP | 09104942 | | | 4/1997 |
| JP | 09-271919 | A | | 10/1997 |
| JP | 09-272945 | A | | 10/1997 |
| WO | WO 9625529 | A1 | | 8/1996 |

* cited by examiner

MAGNESIUM-BASED CASTING ALLOYS HAVING IMPROVED ELEVATED TEMPERATURE PROPERTIES

FIELD OF THE INVENTION

The present invention generally relates to magnesium-based casting alloys having improved elevated temperature properties and more particularlyrelates to magnesium-aluminum-strontium-calcium alloys having improved creep resistance and tensile yield strength, particularly at elevated temperatures of at least 150° C., and good salt-spray corrosion resistance.

BACKGROUND OF THE INVENTION

Magnesium-based alloys have been widely used as cast parts in the aerospace and automotive industries and are mainly based on the following four systems:

Mg—Al system (i.e., AM20, AM50, AM60);

Mg—Al—Zn system (i.e., AZ91D);

Mg—Al—Si system (i.e., AS21, AS41); and

Mg—Al-Rare Earth system (i.e., AE41, AE42).

Magnesium-based alloy cast parts can be produced by conventional casting methods which include diecasting, sand casting, permanentand semi-permanent mold casting, plaster-mold casting and investment casting.

These materials demonstrate a number of particularly advantageous properties that have prompted an increased demand for magnesium-based alloy cast parts in the automotive industry. These properties include low density, high strength-to-weight ratio, good castability, easy machineability and good damping characteristics.

AM and AZ alloys, however, are limited to low-temperature applications because they are known to lose their creep resistance at temperatures above 150° C. AS and AE alloys, while developed for higher temperature applications, offer only a small improvement in creep resistance and/or are expensive.

It is therefore an object of the present invention to provide relatively low cost magnesium-based alloys with improved elevated-temperature properties.

It is a more particular object to provide relatively low cost magnesium-aluminum-strontium-calcium alloys with good creep resistance and tensile yield strength, particularly at elevated temperatures of at least 150° C., and good salt-spray corrosion resistance.

SUMMARY OF THE INVENTION

The present invention therefore provides a magnesium-based casting alloy that comprises: 1 to 12% by weight (wt.) aluminum; 0.1 to 0.6% by wt. strontium; and 0.1 to 0.5% by wt. calcium, with the balance being magnesium except for impurities commonly found in magnesium alloys.

The foregoing and other features and advantages of the present invention will become more apparent from the following description and accompanying drawings.

DETAILED DESCRIPTION OF THE PREFERRED EMBODIMENT

Figure 1:
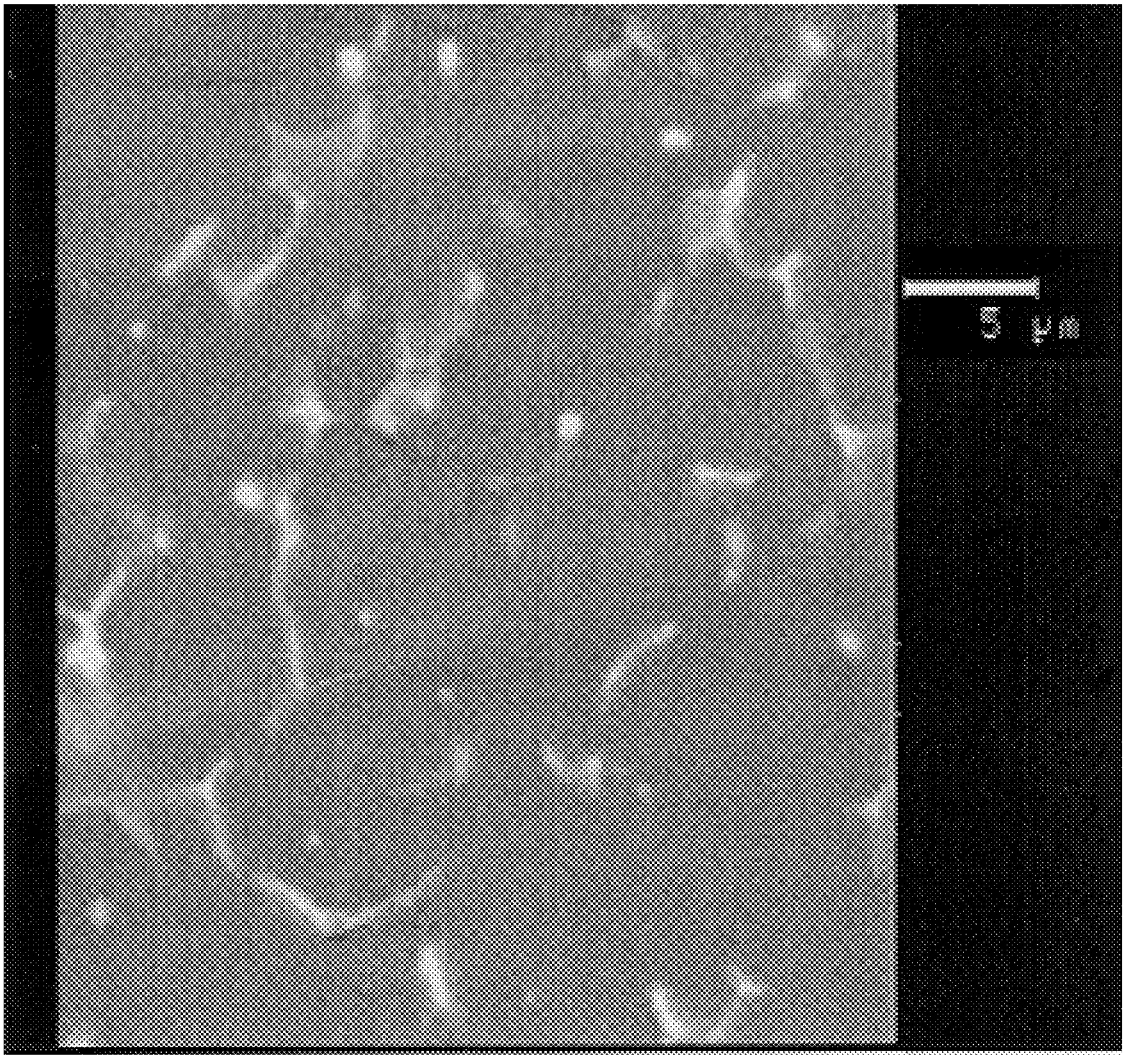
FIG. 1 is a photomicrograph showing the microstructure of a diecast alloy of the present invention, hereinafter referred to as alloy N.

The magnesium-based casting alloys of the present invention are relatively low cost alloys that demonstrate improved creep resistance and tensile yield strength at room temperature, at 150° C. and at 175° C. The inventive alloys also demonstrate good salt-spray corrosion resistance.

More specifically, the inventive magnesium-based casting alloys demonstrate a preferred average % creep extension at 150° C. of ≦0.11% for diecast alloys and ≦0.022% for permanent-mold cast alloys. The inventive diecast alloys further demonstrate a preferred average % creep deformation at 175° C. of ≦0.058%.

In regard to tensile properties, the inventive diecast alloys demonstrate a preferred average tensile yield strength (ASTM E8-99 and E21-92) at room temperature of >132 megapascals (MPa), at 150° C. of >100 MPa, and at 175° C. of >97 MPa. Inventive permanent-mold cast alloys demonstrate a preferred average tensile yield strength at 150° C. of ≧52 MPa.

The average resistance of the inventive diecast alloys to salt-spray corrosion, when measured in accordance with ASTM B117, is preferably ≦0.130 milligrams per square centimeter per day ($mg/cm^2/day$).

As a result of the above-identified properties, the inventive alloys are suitable for use in a wide variety of applications including various elevated temperature automotive applications such as automotive engine components and housings for automotive automatic transmissions.

Moreover, an absence of rare earth elements in the inventive alloys allows for lower production costs.

The inventive alloys are 100% crystalline alloys that contain, in weight percent, 1 to 12% aluminum, 0.1 to 0.6% strontium and 0.1 to 0.5% calcium, with the balance being magnesium. Main impurities commonly found in magnesium alloys, namely—iron (Fe), copper (Cu), nickel (Ni), and silicon (Si) are preferably kept below the following amounts(by weight): Fe≦0.004%; Cu≦0.03%; and Ni≦0.001%, and Si≦0.05% to ensure good salt-spray corrosion resistance.

In addition to the above components, the alloys of the present invention may contain the elements manganese (Mn) and/or zinc (Zn) in the following proportions (by weight): 0–0.50% Mn; and 0–0.40% Zn.

In a preferred embodiment, the inventive magnesium-based alloys contain, in weight percent, 2 to 9% aluminum (more preferably 4.5 to 5.5%), 0.3 to 0.6% strontium (more preferably 0.4 to 0.6%), 0.15 to 0.3% calcium (more preferably 0.15 to 0.25%), 0 to 0.50% manganese (more preferably 0.25 to 0.35%) and 0 to 0.4% zinc (more preferably 0 to 0.2%), with the balance magnesium.

The inventive alloys may advantageously contain other additives provided any such additives do not adversely impact upon the elevated temperature properties and salt-spray corrosion resistance of the inventive alloys.

The inventive alloy can be produced by conventional casting methods which include diecasting, permanent and semi-permanent mold casting, sand-casting, squeeze casting and semi-solid casting and forming. It is noted that such methods involve solidification rates having an order of magnitude of $\leqq 10^2$ K/sec.

In a preferred embodiment, the alloy of the present invention is prepared by melting a magnesium alloy (e.g., AM50), stabilizing the temperature of the melt between 650 and 700° C., and adding a strontium aluminum master alloy (e.g., 90-10 Sr—Al master alloy) to the melt. The temperature of the melt is then maintained at a temperature between 675 and 700° C. for from about 20 to about 40 minutes. The melt is then stirred, a magnesium calcium master alloy (e.g., 70-30 Mg—Ca master alloy) is added to the melt, and the temperature of the melt maintained between 675 and 700° C. for from about 15 to about 30 minutes. The melt is stirred and then cast into a die cavity using either diecasting or permanent mold casting techniques.

The microstructure of a preferred embodiment of the inventive alloy, prepared as set forth immediately hereinabove, is described as follows. The matrix is made up of grains of magnesium having a mean particle size of from about 5 to about 250 micrometers ($\mu$m) (preferably from about 5 to about 10 $\mu$m for alloys in the diecast state and greater than 10 $\mu$m for alloys in the permanent mold cast state). The matrix is reinforced by precipitates of intermetallic compounds dispersed homogeneously therein, preferably at the grain boundaries, that have a mean particle size of from about 2 to about 20 $\mu$m (preferably from about 2 to about 5 $\mu$m for diecast alloys and slightly larger for permanent mold cast alloys). It is noted herein that grain and intermetallic particle sizes will vary depending on the casting conditions employed in the preparation of the inventive alloy.

Scanning electron microscopy of the inventive alloys show that the diecast alloys contain Al—Sr—Ca containing second phases approximately 2 to 10 $\mu$m long and approximately 1 to 2 $\mu$m thick while the permanent mold cast alloys contain Al—Sr—Ca containing second phases approximately 5 to 15 $\mu$m long and approximately 1 to 5 1m thick As best shown by the scanning electron micrographs of FIG. 1, the microstructures of inventive diecast alloy N, which has a chemical composition as described in Table 1 hereinbelow, contain Al—Sr—Ca containing second phases approximately 5 $\mu$m long and 1 $\mu$m thick.

The present invention is described in more detail with reference to the following Examples which are for purposes of illustration only and are not to be understood as indicating or implying any limitation on the broad invention described herein.

WORKING EXAMPLES

Components Used

AM50—a magnesium alloy containing 5.0 (4.4–5.5) % by wt. of aluminum and 0.30 (0.26–0.6) % by wt. of manganese obtained from Norsk-Hydro, Bécancour, Québec, Canada.

90-10 Sr—Al—a strontium-aluminum master alloy containing 90 (89–91) % by master alloy wt. strontium and 10 (9.8–10.2) % by wt. aluminum obtained from Timminco Metals, a division of Timminco Ltd., Haley, Ontario, Canada.

70-30 Mg—Ca—a magnesium-calcium master alloy containing 70 (67–73) % by master alloy wt. magnesium and 30 (27–33) % by wt. calcium, obtained from Timminco Metals.

AZ91D—a magnesium alloy containing 8.9 (8.3–9.7) % by wt. aluminum, 0.7 (0.35–1.0) % by wt. zinc, 0.20 (0.17–0.40) % by wt. manganese, 28 (0.17–0.40) ppm iron, <2 ppm (0.04% by wt. max) copper, 8 ppm (0.025% by wt. max) nickel, 110 ppm (0.001% by wt. max) silicon (all others 0.01% by wt. max), obtained from Norsk-Hydro.

AS41—a magnesium alloy containing 4.8 (3.7–4.8) % by wt. aluminum, 0.21 (0.20 min) % by wt. manganese, 14 ppm (0.20% by wt. max) zinc, 6 ppm (0.04% by wt. max) iron, 46 ppm (0.008–0.015% by wt.) copper, 3 ppm (0.001% by wt. max) nickel, and 0.57 (0.6–1.4) % by wt. silicon, obtained from The Dow Chemical Company, Midland, Mich.

AM60B—a magnesium alloy containing 5.7 (5.6–6.4) % by wt. aluminum and 0.24 (0.23 min) % by wt. manganese obtained from Norsk-Hydro.

AE42—a magnesium alloy containing 3.95 (3.4–4.6) % by wt. aluminum, 0.24 (0.10 min) % by wt. manganese, 30 ppm (0.2% by wt. max) zinc, 10 ppm (0.004% by wt. max) iron, 97 ppm (0.04% by wt. max) copper, 2 ppm (0.001% by wt. max) nickel, and 2 (2–3) % by wt. of rare earth elements, obtained from Magnesium Elektron, Inc., Flemington, N.J.

A380—an aluminum alloy containing 7.92 (7.5–9.5) % by wt. silicon, 2.12 (3.0 max) % by wt. zinc, 2.98 (3.0–4.0) % by wt. copper, 0.14 (0.5 max) % by wt. manganese, 0.85 (0.6–1.3 ) % by wt. iron, 596 ppm (0.5% by wt. max) nickel, 526 ppm (0.1% by wt. max) magnesium, 346 ppm (0.05% by wt. max) chromium, 139 ppm (0.05% by wt. max) tin, and 301 ppm (0.05% by wt. max) titanium, obtained from Roth Bros. Smelting Corp., East Syracuse, N.Y.

Sample Preparation

Alloy N

Alloy N was prepared by: charging ingots of AM50 into an 800 kilogram (kg) crucible positioned in a Dynarad MS-600 electric resistance furnace maintained at 650° C.; melting the charge; stabilizing the temperature of the resulting melt at 670° C.; adding 90-10 Sr—Al master alloy to the melt; maintaining the temperature of the melt at 670° C. for 30 minutes; stirring the melt and adding 70-30 Mg—Ca master alloy to the melt.

The temperature of the melt was maintained at 670° C. for 20 minutes, stirred, and then chemical analysis samples taken by pouring equal quantities of the melt into copper spectrometer molds.

The chemical analysis samples were analyzed using ICP mass spectrometry. The chemical composition of the prepared alloy, namely—N, is shown in Table 1, hereinbelow. The recovery rate of strontium was determined to be approximately 90%, while the recovery rate of calcium was determined to be approximately 85%.

The temperature of the melt was cooled to 500° C. while the ICP chemical analysis was carried out on the melt samples. The melt temperature was monitored by both a furnace controller and by a hand-held K-type thermocouple connected to a Fluke-51 digital thermometer.

During melting and holding, the melt was protected under a gas mixture of 0.5% $SF_6$–25% $CO_2$, balance air.

Alloy N and commercial alloys AZ91D, AS41, AE42, AM60B and A380, in a molten state, were die-cast using a 600-tonne Prince (Prince-629) cold-chamber diecasting machine to produce diecast flat-tensile specimens measuring 8.3×2.5×0.3 cm (gage 1.5×0.6 cm), round tensile specimens measuring 10×1.3 cm (gage 2.54×0.6 cm), cylindrical test specimens measuring 4×2.5 cm and corrosion test plates measuring 10×15×0.5 cm.

Operating parameters used for the cold-chamber diecasting machine are shown below.

| Operating Parameters | AZ91D | AS41 | AE42 | AM60B | A380 | N |
|---|---|---|---|---|---|---|
| Alloy Temp. (° C.) | 680 | 720 | 750 | 750 | 750 | 720 |
| Temperature Of Metal Before Injection (° C.) | 250 | 300 | 300 | 300 | 300 | 275 |
| Pressure (MPa) | 13.8 | 13.8 | 13.8 | 13.8 | 13.8 | 13.8 |
| Piston length (cm) | 3.8/29.2 | 3.8/29.2 | 3.8/29.2 | 3.8/29.2 | 3.8/29.2 | 3.8/29.2 |
| Base speed (cm/sec) | 28–51 | 28–51 | 28–51 | 28–48 | 28–48 | 28–51 |
| Fast speed (cm/sec) | 384–516 | 315–498 | 368–587 | 417 | 312–330 | 384–516 |
| Average cycle time (sec) | 44–58 | 43–73 | 46–50 | 43 | 42–49 | 44–58 |
| Average die opening time (sec) | 30–44 | 29–54 | 32–36 | 18–29 | 18–35 | 30–44 |
| Die Lubricant | Rdl-3188 | Rdl-3188 | Rdl-3188 | Rdl-3188 | Rdl-3188 | Rdl-3188 |

Alloys NC2-NC4, NC6-NC 11

Six (6) different alloys were prepared by: charging approximately 1.8 kg ingots of AM50 into a 2 kg steel crucible positioned in a Lindberg Blue-M electric resistance furnace; melting the charge; stabilizing the temperature of the melt between 675 and 700° C.; and adding small pieces of 90-10 Sr—Al master alloy to the melt, maintaining the temperature of the melt at 670° C. for 30 minutes; stirring the melt; and adding small pieces of 70-30 Mg—Ca master alloy to the melt.

The temperature of the melt was maintained at 670° C. for 20 minutes, stirred, and then chemical analysis samples taken by pouring equal quantities of the melt into copper spectrometer molds.

The chemical analysis samples were analyzed using ICP mass spectrometry. The chemical composition of the prepared alloys, namely—NC2-NC4 and NC6-NC11, are shown in Table 1, hereinbelow. The recovery rate of strontium was determined to be 90%, while the recovery rate of calcium was determined to be 85%.

The temperature of the melt was measured by a K-type Chromel—Alumel thermocouple immersed in the melt.

During melting and holding, the melt was protected under a gas mixture of 0.5% $SF_6$, balance $CO_2$.

Alloys NC2-NC4, and NC6-NC11 and commercial alloys AZ91D, AE42 and A380, in a molten state, were permanent mold cast using an H-13 (mild) steel permanent mold. The mold contained cavities for two ASTM standard test bars, each measuring 14.2 cm in length and 0.7 cm in depth or thickness. Grip width was 1.9 cm while gage length and gage width was 5.08 cm and 1.27 cm, respectively. The mold was provided with a sprue, riser and gating system to bottom-feed the two tensile bar cavities.

TABLE 1

Chemical Composition of Diecast and Permanent-Mold Cast Alloys

| | Al (wt %) | Sr (wt %) | Ca | Mn (wt %) | Zn (ppm) | Fe (ppm) | Cu (ppm) | Ni (ppm) | Si (ppm) |
|---|---|---|---|---|---|---|---|---|---|
| DIECAST ALLOYS | | | | | | | | | |
| AM 50 | 5.0 | — | 20 ppm | 0.32 | 200 | 20 | 10 | 10 | 70 ppm |
| 90-10 Sr—Al master alloy | 10 | 90 | 535 ppm | — | — | | | | |
| 70-30 Mg—Ca master alloy | 0.23 | — | 30.2 wt % | — | 290 | 977 | <2 | <2 | <10 |
| N | 4.80 | 0.56 | 0.16 wt % | 0.34 | 81 | 11 | 2 | 3 | 46 ppm |
| PERMANENT-MOLD CAST ALLOYS | | | | | | | | | |
| AM50 | 5.0 | — | — | 0.32 | 200 | 20 | 10 | 10 | 70 |
| 90-10 Sr—Al master alloy | 9.78 | 90.11 | 535 wt % | 0.0005 | 112 | 221 | 35 | 33 | 150 |
| 70-30 Mg—Ca master alloy | 0.23 | — | 30.2 wt % | — | 290 | 977 | <2 | <2 | <10 |
| NC2 | 5.1 | 0.4 | 0.15 wt % | 0.30 | 45 | 89 | <2 | 5 | 36 |
| NC3 | 5.19 | 0.3 | 0.20 wt % | 0.29 | 50 | 38 | 3 | 4 | 714 |
| NC4 | 5.27 | 0.44 | 0.22 wt % | 0.31 | 47 | 29 | 3 | 3 | 681 |
| NC6 | 5.21 | 0.52 | 0.32 wt % | 0.29 | 44 | 17 | <2 | 2 | 706 |
| NC7 | 5.26 | 0.51 | 0.20 wt % | 0.30 | 46 | 38 | <2 | 3 | 16 |
| NC8 | 5.17 | 0.31 | 0.30 wt % | 0.31 | 42 | 39 | <2 | 3 | 18 |
| NC9/NC11 | 5.34 | 0.42 | 0.11 wt % | 0.31 | 47 | 55 | <2 | 3 | 49 |

Various properties of the alloys were then tested as set forth below and compared against other magnesium alloys and aluminum alloy A380.

Test Methods

The diecast and permanent mold cast test specimens were subjected to the following tests:

Creep Resistance or Creep Extension

The creep resistance of the diecast and permanent mold cast test specimens was measured in accordance with ASTM E139-83 at 150° C. and at 175° C. In particular, test specimens were exposed to air for a period of 60 minutes and then subjected, for a period of 200 hr, to a constant stress of 35 MPa via an Applied Test Systems, Inc. (ATS) Lever Arm Tester-2320 creep testing machine while being maintained at either a temperature of 150° C. or 175° C. The gage length of each test specimen was then measured and the difference between the original gage length (i. e., 1.27 cm) and the gage length of each specimen at the end of the 200 hr test period was determined. The difference in gage length determined for each test specimen was then divided by 1.27 cm and the result reported as a percent (%).

Tensile Properties

Tensile properties (i.e., tensile yield strength, ultimate tensile strength and elongation) at elevated temperatures of 150° C. and 175° C. and at room temperature were measured in accordance with ASTM E8-99 and E21-92. An Instron servovalve hydraulic Universal Testing Machine (model number 8502-1988) equipped with an Instron oven (model number 3116) and an Instron extensiometer (model number 2630-052) were used in conjunction with the subject test methods.

For tensile testing at elevated temperatures, test specimens were clamped within the test assembly and heated to either a temperature of 150° C. or 175° C. and then maintained at this temperature for a period of 30 minutes. Specimens were then tested at 0.13 cm/cm/min through yield and at 1.9 cm/min to failure.

For room temperature tensile testing, specimens were tested at 0.7 MPa/min through yield and at 1.9 cm/min to failure.

Tensile yield strength was determined by passing a tangent to the part of the stress-strain curve between 20.5–34.5 MPa and by passing a second line parallel to the one intersecting the y-axis at a 0.2% extension. Results are reported in megapascals (MPa).

Ultimate tensile strength was determined as the stress at rupture or as the maximum stress in the stress-strain curve. Results are reported in MPa.

Elongation was determined by measuring the gage length of each test specimen before and after testing. Results are reported in percent (%).

Salt-Spray Corrosion Resistance

The resistance of the diecast corrosion test plate test specimens to corrosion was measured in accordance with ASTM B117. In particular, specimens were cleaned using a 4% NaOH solution at 80° C., rinsed in cold water and dried with acetone. The specimens were then weighed and then vertically mounted at 20° from the vertical axis within a SINGLETON salt-spray test cabinet (model number SCCH #22). The vertically mounted specimens were then exposed to a 5% NaOH/distilled water fog for a period of 200 hr. During the test period, the fog tower was adjusted to a collection rate of 1 cc/hr and the parameters of the cabinet checked every 2 days. At the end of the 200 hr test period, the specimens were removed, washed in cold water and cleaned in a chromic acid solution (i.e., chromic acid containing silver nitrate and barium nitrate) as per ASTM B117. The samples were then re-weighed and the weight change per sample determined. The results are reported in milligrams per square centimeter per day (mg/cm$^2$/day).

EXAMPLE 1 AND COMPARATIVE EXAMPLES C1 TO C4

In these examples diecast specimens prepared in accordance with the teachings of the present invention and diecast magnesium alloys AZ91D, AE42 and AS41 and aluminum alloy A380 were tested for creep resistance and various tensile properties at room temperature, at 150° C. and at 175° C. The inventive diecast specimens and diecast alloys AZ91D, AE42, AS41, AM60B and A380 were then tested for salt-spray corrosion resistance. The results are tabulated in Table 2.

TABLE 2

Summary of Example 1 and Comparative Examples C1–C5

| EXAMPLE | 1 | C1 | C2 | C3 | C4 | C5 |
|---|---|---|---|---|---|---|
| ALLOY | N | AZ91D | AE42 | AS41 | A380 | AM60B |
| Properties: | | | | | | |
| Creep Extension (%) at 150° C. | | | | | | |
| Run 1 | 0.12% | 1.64% | 0.09% | 0.168% | 0.192% | |
| Run 2 | 0.13% | 0.90% | 0.064% | 0.102% | 0.154% | |
| Run 3 | 0.09% | 1.08% | 0.05% | 0.12% | 0.18% | |
| AVERAGE | 0.11% | 1.21% | 0.07% | 0.13% | 0.I8% | |
| Creep Extension (%) at 175° C. | | | | | | |
| Run 1 | 0.085% | 2.03% | 0.094% | 0.61% | 0.132% | |
| Run 2 | 0.0205% | 1.65% | 0.182% | 0.75% | 0.151% | |
| Run 3 | 0.069% | — | 0.140% | 0.148% | 0.166% | |
| AVERAGE | 0.058% | 1.84% | 0.14% | 0.5% | 0.15% | |
| Tensile Properties at Room Temperature: | | | | | | |
| Yield Strength (MPa) | | | | | | |
| Run 1 | 126.8 | 154.1 | 132.0 | 118.1 | 141.9 | |
| Run 2 | 130.6 | 156.9 | 131.5 | 139.3 | 157.8 | |
| Run 3 | 130.1 | 150.8 | 130.9 | 136.8 | 160.6 | |
| Run 4 | 132.7 | 154.8 | 131.2 | 135.7 | 156.4 | |
| Run 5 | 132.1 | — | 131.0 | 129.6 | 155.9 | |
| Run 6 | 137.9 | 162.1 | 137.9 | 148.2 | 162.0 | |
| Run 7 | 134.5 | 158.6 | 137.9 | 151.7 | 148.2 | |
| Run 8 | 134.5 | 158.6 | 137.9 | 131.0 | 158.6 | |
| AVERAGE | 132.7 | 156.6 | 133.8 | 123.8 | 155.2 | |
| Ultimate Tensile Strength (MPa) | | | | | | |
| Run 1 | 240.3 | 257.0 | 240.3 | 255.4 | 247.4 | |
| Run 2 | 235.5 | 249.4 | 221.6 | 231.0 | 233.0 | |

TABLE 2-continued

Summary of Example 1 and Comparative Examples C1–C5

| EXAMPLE<br>ALLOY | 1<br>N | C1<br>AZ91D | C2<br>AE42 | C3<br>AS41 | C4<br>A380 | C5<br>AM60B |
|---|---|---|---|---|---|---|
| Run 3 | 258.5 | 220.7 | 212.8 | 241.5 | 332.5 | |
| Run 4 | 249.2 | 231.5 | 240.3 | 254.6 | 312.1 | |
| Run 5 | 228.4 | — | 240.7 | 262.6 | 323.5 | |
| Run 6 | 234.5 | 231.0 | 206.9 | 196.5 | 310.3 | |
| Run 7 | 220.7 | 227.6 | 227.6 | 217.2 | 251.7 | |
| Run 8 | 231.0 | 248.3 | 224.1 | 231.0 | 317.2 | |
| AVERAGE | 237.3 | 237.9 | 226.8 | 236.3 | 291.0 | |
| Elongation % | | | | | | |
| Run 1 | 12.2 | 5.6 | 13.2 | 11.0 | 1.8 | |
| Run 2 | 11.4 | 4.4 | 8.3 | 5.4 | 1.7 | |
| Run 3 | 8.1 | 3.6 | 5.6 | 8.0 | 4.7 | |
| Run 4 | 15.9 | 3.5 | 12.4 | 9.8 | 4.0 | |
| Run 5 | 8.9 | 4.3 | 10.2 | 10.1 | 3.0 | |
| Run 6 | 10.0 | 5.0 | 6.2 | 3.3 | 4.4 | |
| Run 7 | 7.5 | 5.0 | 10.0 | 4.4 | 2.2 | |
| Run 8 | 10.0 | 6.2 | 8.7 | 7.8 | 3.4 | |
| AVERAGE | 10.5 | 4.7 | 9.3 | 7.4 | 3.2 | |
| Tensile Properties at 150° C.: | | | | | | |
| Yield Strength (MPa) | | | | | | |
| Run 1 | 107.4 | 108.2 | 85.4 | 87.7 | 168.5 | |
| Run 2 | 100 | 99.5 | 96.2 | 96.3 | 147.6 | |
| Run 3 | 99.9 | 104.4 | 87.2 | 92.0 | 152.0 | |
| Run 4 | 98.5 | — | 85.0 | 98.4 | 146.5 | |
| Run 5 | 96.6 | 106.9 | 89.7 | 89.4 | 158.6 | |
| Run 6 | 96.6 | 106.9 | 82.8 | 89.6 | 148.2 | |
| Run 7 | 103.4 | 103.4 | 86.2 | 93.1 | 137.9 | |
| AVERAGE | 100.3 | 104.9 | 87.5 | 92.4 | 151.3 | |
| Ultimate Tensile Strength (MPa) | | | | | | |
| Run 1 | 163.5 | 179.9 | 139.9 | 154.0 | 293.0 | |
| Run 2 | 156 | 161.6 | 162.6 | 153.0 | 235.7 | |
| Run 3 | 163.5 | 174.3 | 152.3 | 155.3 | 264.3 | |
| Run 4 | 158.4 | — | 143.5 | 147.9 | 259.9 | |
| Run 5 | 141.4 | 169.0 | 137.9 | 144.8 | 251.7 | |
| Run 6 | 137.4 | 169.0 | 127.6 | 137.9 | 255.1 | |
| Run 7 | 148.3 | 165.5 | 137.9 | 155.1 | 220.6 | |
| AVERAGE | 152.7 | 169.9 | 143.0 | 149.7 | 254.3 | |
| Elongation % | | | | | | |
| Run 1 | 19.9 | 20.6 | 16.1 | 19.8 | 4.4 | |
| Run 2 | 13.3 | 12.5 | 24.4 | 20.4 | 3.1 | |
| Run 3 | 24.2 | 12.6 | 30.2 | 19.5 | 7.5 | |
| Run 4 | 19.6 | — | 25.6 | 7.4 | 7.5 | |
| Run 5 | 10.4 | 19.5 | 21.6 | 17.6 | 4.5 | |
| Run 6 | 7.8 | 11.7 | 22.3 | 16.7 | 7.9 | |
| Run 7 | 22.1 | 19.5 | 24.6 | 17.8 | 4.5 | |
| AVERAGE | 16.8 | 16 | 23.5 | 17 | 6.7 | |
| Tensile Properties at 175° C.: | | | | | | |
| Yield Strength (MPa) | | | | | | |
| Run 1 | 100.2 | 87.9 | 81.6 | 81.6 | 147.3 | |
| Run 2 | 97.3 | 92.2 | 86.2 | 88.5 | 153.3 | |
| Run 3 | 96.9 | 88.0 | 72.1 | 83.6 | 160.2 | |
| Run 4 | 96.6 | 86.7 | 82.1 | 85.3 | 155.9 | |
| Run 5 | 96.4 | 90.1 | 83.8 | 85.2 | — | |
| AVERAGE | 97.5 | 89.0 | 81.2 | 84.8 | 154.2 | |
| Ultimate Tensile Strength (MPa) | | | | | | |
| Run 1 | 137.4 | 140.5 | 122.2 | 124.4 | 250.5 | |
| Run 2 | 139.8 | 142.2 | 119.9 | 131.0 | 250.4 | |
| Run 3 | 139.4 | 134.2 | 115.8 | 127.2 | 248.8 | |
| Run 4 | 135.0 | 135.5 | 120.3 | 126.9 | 240.5 | |
| Run 5 | 132.7 | 138.8 | 124.4 | 127.2 | — | |
| AVERAGE | 136.8 | 138.2 | 120.5 | 127.3 | 247.5 | |
| Elongation % | | | | | | |
| Run 1 | 11.4 | 16.9 | 21.2 | 12.4 | 6.7 | |
| Run 2 | 20.1 | 24.1 | 24.9 | 23.2 | 9.7 | |
| Run 3 | 23.1 | 20.0 | 11.9 | 16.1 | 7.0 | |
| Run 4 | 27.1 | 20.6 | 23.5 | 19.0 | 4.9 | |
| Run 5 | 18.8 | 20.8 | 34.1 | 19.2 | — | |
| AVERAGE | 20.1 | 20.5 | 23.1 | 18.0 | 7.1 | |

TABLE 2-continued

| Summary of Example 1 and Comparative Examples C1–C5 | | | | | | |
|---|---|---|---|---|---|---|
| EXAMPLE | 1 | C1 | C2 | C3 | C4 | C5 |
| ALLOY | N | AZ91D | AE42 | AS41 | A380 | AM60B |
| Salt-Spray Corrosion Rate (mg/cm$^2$/day) | | | | | | |
| Run 1 | 0.128 | 0.127 | 0.172 | 0.019 | 0.322 | 0.307 |
| Run 2 | 0.136 | 0.097 | 0.251 | 0.174 | 0.330 | 0.236 |
| Run 3 | 0.127 | 0.085 | 0.144 | 0.317 | 0.380 | 0.175 |
| AVERAGE | 0.130 | 0.103 | 0.189 | 0.170 | 0.344 | 0.260 |

A review of the average creep extension, tensile properties, and salt-spray corrosion rate values in Table 2 indicates that the magnesium-based casting alloys of the present invention demonstrate a balance of desirable properties, including improved creep resistance and tensile yield strength, particularly at elevated temperatures of at least 150° C., and good salt-spray corrosion resistance, as compared to magnesium alloys AZ91D, AE42, AS41 and AM60B and aluminum alloy A380.

In particular, Example 1 demonstrated improved creep resistance at 150° C. over Comparative Examples C1(AZ91D), C3(AS41) and C4(A380) and outperformed Comparative Examples C1, C2 and C4, when tested for creep resistance at 175° C.

In terms of tensile properties, Example 1 demonstrated improved yield strength at room temperature, at 150° C. and at 175° C. over Comparative Example C3(AS41). More specifically, the average tensile yield strength at room temperature of Example 1 was 132.7 MPa, which exceeded the average value obtained for C3(AS41). In terms of average tensile yield strength values at 150° C., Example 1 outperformed C2(AE42) and C3(AS41), while the average tensile yield strength at 175° C. obtained for Example 1 (i.e., 97.5 MPa) exceeded all alloys tested except C4(A380).

In terms of ultimate tensile strength, Example 1 consistently outperformed C2(AE42) and C3(AS41) at room temperature, at 150° C. and at 175° C. In addition, Example 1 consistently outperformed C4(A380) in terms of % elongation at room temperature, at 150° C. and at 175° C.

Example 1 further demonstrated improved salt-spray corrosion resistance over Comparative Examples C2(AE42), C3(AS41), C4(A380) and C5(AM60B).

EXAMPLES 2 TO 7 AND COMPARATIVE EXAMPLES C6 TO C8

In these examples permanent mold cast ASTM standard flat tensile specimens prepared in accordance with the present invention and permanent mold cast magnesium alloys AZ91D and AE42 and aluminum alloy A380 were tested for creep resistance. The results are tabulated in Table 3.

TABLE 3

| Summary of Examples 2 to 7 and Comparative Examples C6 to C8 | | | | | | | | | |
|---|---|---|---|---|---|---|---|---|---|
| EXAMPLE | 2 | 3 | 4 | 5 | 6 | 7 | C6 | C7 | C8 |
| ALLOY | NC3 | NC4 | NC6 | NC7 | NC8 | NC9-NC11 | AZ91D | AE42 | A380 |
| Properties: Creep Extension (%) at 150° C. | | | | | | | | | |
| Run 1 | 0.0216% | 0.012% | 0.0053% | 0.0033% | 0.0132% | 0.0175% | 0.136% | 0.035% | 0.092% |
| Run 2 | 0.0064% | 0.0142% | 0.0225% | 0.0048% | 0.021% | 0.027% | — | 0.014% | 0.099% |
| Run 3 | — | — | — | 0.021% | 0.0215% | — | — | — | — |
| AVERAGE | 0.014% | 0.013% | 0.014% | 0.020% | 0.019% | 0.022% | 0.136% | 0.025% | 0.096% |

By way of the average creep extension values shown in Table 3, it can be seen that the permanent mold cast alloys of the present invention (i.e., Examples 2 to 7) demonstrate improved creep resistance at 150° C. over all alloys tested (i.e., C6(AZ91D), C7(AE42) and C8(A380)).

EXAMPLES 8 TO 9 AND COMPARATIVE EXAMPLES C9 TO C11

In these examples permanent mold cast ASTM standard flat tensile specimens prepared in accordance with the present invention and permanent mold cast magnesium alloys AZ91D and AE42 and aluminum alloy A380 were tested for tensile properties at 150° C. The results are tabulated in Table 4.

TABLE 4

| Summary of Examples 8 to 9 and Comparative Examples C9 to C11 | | | | | |
|---|---|---|---|---|---|
| EXAMPLE | 8 | 9 | C9 | C10 | C11 |
| ALLOY | NC2 | NC9-NC11 | AZ91D | AE42 | A380 |
| Properties: Tensile Properties at 150° C. Yield Strength (MPa) | | | | | |
| Run 1 | 52.7 | 51.7 | 81.2 | 43.9 | 124.3 |
| Run 2 | — | 62.5 | 78.7 | 48 | 126.4 |
| Run 3 | — | 51.5 | 79.4 | 43.4 | — |
| Run 4 | — | 58.6 | 93.1 | 44.8 | — |
| AVERAGE | 52.7 | 56.6 | 83.1 | 45 | 125.4 |

TABLE 4-continued

Summary of Examples 8 to 9 and Comparative Examples C9 to C11

| EXAMPLE<br>ALLOY | 8<br>NC2 | 9<br>NC9-NC11 | C9<br>AZ91D | C10<br>AE42 | C11<br>A380 |
|---|---|---|---|---|---|
| Ultimate Tensile Strength (MPa) | | | | | |
| Run 1 | 98.9 | 79.3 | 169.9 | 111 | 187.5 |
| Run 2 | — | 111.8 | 176.7 | 113.2 | 162.4 |
| Run 3 | — | 78.5 | 166.5 | 113.4 | — |
| Run 4 | — | 108.3 | 162.1 | 117.2 | — |
| AVERAGE | 98.9 | 95.6 | 168.8 | 113.6 | 175 |
| Elongation % | | | | | |
| Run 1 | 3.5 | 3.5 | 5.6 | 10.5 | 1.3 |
| Run 2 | — | 5.6 | 11 | 11.3 | 0.9 |
| Run 3 | — | 1.4 | 8.7 | 11 | — |
| Run 4 | — | 4.2 | 9 | 3 | — |
| AVERAGE | 3.5% | 3.7% | 8.6% | 9.0% | 1.1% |

By way of the average tensile values shown in Table 4, it can be seen that the permanent mold cast alloys of the present invention (i.e., Examples 8 and 9) demonstrate improved yield strength at 150° C. when compared to magnesium alloy AE42 (i.e., C10). Examples 8 and 9 further demonstrate improved % elongation at 150° C. when compared to aluminum alloy A380 (i.e., C11).

Having thus described the invention, what is claimed is:

1. A magnesium-based casting alloy having improved elevated temperature properties, which consists of, in weight percent, 1 to 12% aluminum, 0.1 to 0.6% strontium, and 0.1 to 0.5% calcium, with the balance being magnesium except for impurities commonly found in magnesium alloys, wherein said magnesium-based casting alloy contains less than or equal to 0.05% of silicon impurity, and is free of rare earth elements, and wherein said alloy has a structure including a matrix of grains of magnesium having a mean particle size of from 5 to about 250 micrometers reinforced by intermetallic compounds having a mean particle size of from 2 to about 20 micrometers.

2. The magnesium-based casting alloy of claim 1, wherein said alloy comprises 2 to 9% aluminum.

3. The magnesium-based casting alloy of claim 1, wherein said alloy comprises 0.3 to 0.6% strontium.

4. The magnesium-based casting alloy of claim 1, wherein said alloy is a diecast alloy having an average % creep extension at 175° C. of less than or equal to 0.058%, a tensile yield strength at 175° C. of greater than or equal to 97 megapascals, and a salt-spray corrosion rate of less than or equal to 0.130 milligrams per square centimeter per day.

5. The magnesium-based casting alloy of claim 1, wherein said alloy is a permanent-mold cast alloy having has an average % creep extension at 150° C. of less than or equal to 0.022% and a tensile yield strength at 150° C. of greater than or equal to 52 megapascals.

6. The magnesium-based casting alloy of claim 1, wherein said alloy comprises 0.15 to 0.3% calcium.

7. A magnesium-based casting alloy having improved elevated temperature properties, which consists of, in weight percent, 1 to 12% aluminum, 0.1 to 0.6% strontium, 0.1 to 0.5% calcium, 0 to 0.50% manganese, and 0 to 0.4% zinc, with the balance being magnesium except for impurities commonly found in magnesium alloys, wherein said magnesium-based casting alloy contains less than or equal to 0.05% of silicon impurity, and is free of rare earth elements, and wherein said alloy has a structure including a matrix of grains of magnesium having a mean particle size of from 5 to about 250 micrometers reinforced by intermetallic compounds having a mean particle size of from 2 to about 20 micrometers.

8. The magnesium-based casting alloy of claim 7, wherein said alloy comprises 2 to 9% aluminum.

9. The magnesium-based casting alloy of claim 7, wherein said alloy comprises 0.3 to 0.6% strontium.

10. The magnesium-based casting alloy of claim 7, where said alloy comprises 0.25 to 0.35% manganese.

11. The magnesium-based casting alloy of claim 7, where said alloy comprises 0 to 0.2% zinc.

12. The magnesium-based casting alloy of claim 7, wherein said alloy is a diecast alloy having an average % creep extension at 175° C. of less than or equal to 0.058%, a tensile yield strength at 175° C. of greater than or equal to 97 megapascals, and a salt-spray corrosion rate of less than or equal to 0.130 milligrams per square centimeter per day.

13. The magnesium-based casting alloy of claim 7, wherein said alloy is a permanent-mold cast alloy having an average % creep extension at 150° C. of less than or equal to 0.022% and a tensile yield strength at 150° C. of greater than or equal to 52 megapascals.

14. The magnesium-based casting alloy of claim 7, wherein said alloy comprises 0.15 to 0.3% calcium.

* * * * *